US011566376B2

(12) United States Patent
Ji et al.

(10) Patent No.: US 11,566,376 B2
(45) **Date of Patent: *Jan. 31, 2023**

(54) METHOD FOR PREPARING UNBLEACHED BIOMECHANICAL PULP FROM STRAW

(71) Applicant: QILU UNIVERSITY OF TECHNOLOGY, Shandong (CN)

(72) Inventors: Xingxiang Ji, Jinan (CN); Ruiming Wang, Jinan (CN); Zhongjian Tian, Jinan (CN); Jiachuan Chen, Jinan (CN); Guihua Yang, Jinan (CN); Yuqian Guo, Jinan (CN)

(73) Assignee: QILU UNIVERSITY OF TECHNOLOGY, Jinan (CN)

( * ) Notice: Subject to any disclaimer, the term of this patent is extended or adjusted under 35 U.S.C. 154(b) by 259 days.

This patent is subject to a terminal disclaimer.

(21) Appl. No.: 16/772,509

(22) PCT Filed: Apr. 29, 2019

(86) PCT No.: PCT/CN2019/084968
§ 371 (c)(1),
(2) Date: Jun. 12, 2020

(87) PCT Pub. No.: WO2020/133856
PCT Pub. Date: Jul. 2, 2020

(65) Prior Publication Data

US 2020/0362515 A1 Nov. 19, 2020

(30) Foreign Application Priority Data

Dec. 29, 2018 (CN) ..... 201811640567.X

(51) Int. Cl.

| | |
|---|---|
| ***D21H 11/12*** | (2006.01) |
| ***D21C 1/06*** | (2006.01) |
| ***D21C 5/00*** | (2006.01) |
| ***D21C 9/02*** | (2006.01) |
| ***D21C 1/02*** | (2006.01) |
| ***D21D 1/20*** | (2006.01) |
| *D21B 1/06* | (2006.01) |

(52) U.S. Cl.
CPC ..... *D21H 11/12* (2013.01); *D21C 1/02* (2013.01); *D21C 1/06* (2013.01); *D21C 5/005* (2013.01); *D21C 9/02* (2013.01); *D21D 1/20* (2013.01); *D21B 1/061* (2013.01)

(58) Field of Classification Search
CPC . D21C 1/02; D21C 1/04; D21C 5/005; D21C 3/26; D21C 3/02; D21H 17/005
See application file for complete search history.

(56) References Cited

U.S. PATENT DOCUMENTS

| | | | | |
|---|---|---|---|---|
| 4,040,899 | A * | 8/1977 | Emerson | D21G 9/00 162/13 |
| 5,656,129 | A * | 8/1997 | Good | D01C 1/00 162/13 |
| 6,419,788 | B1 * | 7/2002 | Wingerson | D21C 1/02 162/14 |
| 10,344,303 | B2 * | 7/2019 | Retsina | C12P 7/14 |
| 10,604,777 | B2 * | 3/2020 | Vainio | C12P 19/14 |
| 2005/0241785 | A1 * | 11/2005 | Peng | D21B 1/021 162/96 |
| 2011/0061825 | A1 * | 3/2011 | Li | D21C 5/00 162/13 |
| 2012/0325421 | A1 * | 12/2012 | Li | C05F 17/80 162/189 |
| 2013/0143278 | A1 * | 6/2013 | Tolan | C12P 7/14 435/162 |

FOREIGN PATENT DOCUMENTS

| | | | |
|---|---|---|---|
| CN | 1681992 | A | 10/2005 |
| CN | 103243597 | A | 8/2013 |
| CN | 109098025 | A | 12/2018 |
| CN | 109577072 | A | 4/2019 |

OTHER PUBLICATIONS

Sep. 19, 2019 International Search Report issued in International Patent Application No. PCT/CN2019/084968.
Sep. 19, 2019 Written Opinion issued in International Patent Application No. PCT/CN2019/084968.

* cited by examiner

*Primary Examiner* — Anthony Calandra
(74) *Attorney, Agent, or Firm* — Oliff PLC

(57) ABSTRACT

A method for preparing unbleached biomechanical pulp from straw. Straw is used as a raw material, which is firstly pre-treated with hot water and hot steam, added with a small amount of alkali, and then softened by saturation with hot water, enzymatically treated by adding alkaline biological enzymes, refined, and washed. This method has the advantage that the whole production process does not need alkali recovery, thereby avoiding environmental pollution from the source. This technology conforms to the national industrial policy of resource conservation, economic recycling, energy saving and emission reduction. The present invention overcomes the problems of difficulty in recovering the alkali wastewater accompanying straw pulp and serious pollution in the prior art. This is of great significance for the industrial production of straw pulp and the development of the paper industry.

7 Claims, No Drawings

METHOD FOR PREPARING UNBLEACHED BIOMECHANICAL PULP FROM STRAW

BACKGROUND

Technical Field

The present invention relates to the technical field of paper technology and particularly to a method for preparing unbleached biomechanical pulp from straw.

Related Art

In 2016, pulp imports reached 21.06 million tons, and waste paper imports reached 28.5 million tons in China. The degree of dependence on the import of papermaking fiber raw materials was close to 50%. The large waste paper imports made up the deficiency in fiber raw materials in China and supported the development of the paper industry. In April 2017, the Central Government of China issued "The latest progress of prohibiting import the foreign waste, Progress on the implementation of the reform of the import management system for solid waste", which clearly stipulates that from the end of this year, China will ban the import of unsorted waste paper. In 2018, the total waste paper imports were 33% of 2017. By 2020, the import of waste paper will be prohibited in China. China is facing a shortage of about 26 million tons of papermaking raw materials every year. The shortage of resources in the traditional paper industry will be further highlighted. Development of new papermaking raw materials is imminent. To this end, the researchers make explorations on recyclable and renewable grass raw materials to find new papermaking raw materials.

In the traditional chemical pulping process, most of the hemicellulose in plant raw materials is degraded and dissolved in the pulping black liquor. The black liquor is usually treated by burning to recover heat energy and chemicals. Because the hemicellulose in the black liquor has a low heat of burning, treatment by burning it directly will not only cause the waste of energy, but also the consumption of very good biomass resources. At present, the most severe problem existing in the development of grass resources for pulping and papermaking is the pollution, which is also a vital problem caused by the presence of straw pulp and a key issue underlying whether the straw pulp can survive.

Therefore, the development of a low-pollution, low-energy-consumption, and high-quality pulping method suitable for straw pulp is a focus of research in the paper industry in China, and also a bottleneck that needs to be broken in the development of the industry.

SUMMARY

In view of the above problems, the present invention provides a method for preparing unbleached biomechanical pulp from straw. Straw as raw material for pulping is treated with steam or hot water, then a small amount of alkali (NaOH or KOH) is added to adjust the pH to 10-14, the straw is softened by hydrothermal saturation, then the temperature of the straw is adjusted, alkaline compound enzymes are added for biological treatment, and finally the straw is refined, where the prepared mechanical pulp can meet the requirements of producing unbleached packaging paper and paper-based materials.

The following technical solutions are adopted in the present invention.

In a first aspect, a method for preparing an unbleached biomechanical pulp from straw is provided, which comprises the following steps:

(1) cutting the physically selected dedusted straw into 1-8 cm small raw materials, transferring them to a treatment vessel or reactor, and treating the straw with steam or hot water at a solid/liquid ratio of 1:4-1:8, for a time controlled to 15-90 min;

(2) adding NaOH or KOH to the mixture of hot water and straw in the reactor or the treatment vessel, to adjust the pH of the hot water to 10-14, and softening the straw by hydrothermal saturation;

(3) treating the straw that is softened by hydrothermal saturation with alkaline biological compound enzymes (in a biotreatment vessel for 30-90 min at a solid/liquid ratio controlled to 1:3-1:10 (W/V));

(4) refining the straw treated in Step (3) with a refiner;

(5) washing with water after refining to obtain a biomechanical pulp, where after washing the pulp, the water is treated with a multi-purpose evaporator, the solid residue is recovered for incineration in a boiler, and the heat energy is recovered for the treatment with hot water or steam in Step (1); and (6) defibrating the obtained biomechanical pulp by a defibrater and evenly mixing.

In a second aspect of the present invention, a mechanical pulp prepared by the method described above is provided.

In a third aspect of the present invention, use of the mechanical pulp described above in the preparation of unbleached packaging paper and paper-based materials is provided.

The present invention has the following beneficial effects.

In the present invention, straw is used as a raw material, which is firstly pre-treated with hot water and hot steam, added with a small amount of alkali, and then softened by saturation with hot water, enzymatically treated by adding alkaline biological enzymes, refined, and washed. In the present invention, when the refining is completed, the pH of the biomechanical pulp is close to neutral, and after washing the pulp, the water is treated with a multi-purpose evaporator, the solid residue is recovered for incineration in a boiler, and the heat energy is recovered for use in the pretreatment section with hot water. The whole production process does not need alkali recovery, thereby avoiding environmental pollution from the source. This technology conforms to the national industrial policy of resource conservation, economic recycling, energy saving and emission reduction. It overcomes the problems of difficulty in recovering the alkali wastewater accompanying straw pulp and serious pollution in the prior art. This is of great significance for the industrial production of straw pulp and the development of the paper industry.

In the present invention, straw is used as a raw material to produce mechanical pulp, which not only raises the utilization rate and added value of agricultural residues and improves the farmers' income, but also solves the problem that straw has to be burned since it cannot be fully used and the environmental problems thus caused.

In the present invention, steam or hot water is used to treat straw, which can partially dissolve the resin compounds in the straw pulp, so as to reduce the pitch problems caused during the papermaking process. After treatment with hot water, a small amount of alkali is added to partially dissolve lignin and also dissolve some components such as pectin and hemicellulose. Then alkaline compound enzymes are added. By adjusting the ratio, dosage and treatment time with the alkaline compound enzymes, hemicellulose and lignin can be effectively extracted and a high pulp yield and pulp quality can be guaranteed. The pulping yield of the method of the present invention is more than 75%, and various physical indexes are high.

The method of the present invention is simple and has low requirements on the equipment, and is suitable for the production of large and medium-sized pulp and paper production lines.

DETAILED DESCRIPTION

It should be noted that the following detailed description is exemplary and is intended to provide a further description of the present invention. All technical and scientific terms used herein have the same meaning as commonly understood by one of ordinary skill in the art to which this invention belongs, unless otherwise indicated.

It is to be noted that the terminology used herein is for the purpose of describing particular embodiments, and is not intended to limit the exemplary embodiments of the present invention. As used herein, the singular terms are also intended to include the plural, and it is also to be understood that when the terms "include" and/or "comprise" are used in the specification, they indicate the presence of features, steps, operations and/or combinations thereof, unless otherwise indicated.

In a first aspect, a method for preparing an unbleached biomechanical pulp from straw is provided, which comprises the following steps:

(1) cutting the physically selected dedusted straw into 1-8 cm small raw materials, transferring them to a treatment vessel or reactor, and treating the straw with steam or hot water at a solid/liquid ratio of 1:4-1:8, for a time controlled to 15-90 min;

(2) adding NaOH or KOH to the mixture of hot water and straw in the reactor or the treatment vessel, to adjust the pH of the hot water to 10-14, and softening the straw by hydrothermal saturation;

(3) treating the straw that is softened by hydrothermal saturation with alkaline biological compound enzymes (in a biotreatment vessel for 30-90 min at a solid/liquid ratio controlled to 1:3-1:10 (W/V));

(4) refining the straw treated in Step (3) with a refiner;

(5) washing with water after refining to obtain a biomechanical pulp, where after washing the pulp, the water is treated with a multi-purpose evaporator, the solid residue is recovered for incineration in a boiler, and the heat energy is recovered for the treatment with hot water or steam in Step (1); and (6) defibrating the obtained biomechanical pulp by a defibrater and evenly mixing.

Further, the treatment with steam or hot water in Step (1) is controlled at 80-120° C.

Treatment with hot water or hot steam within this temperature range can partially dissolve the resin compounds in the straw, so as to reduce the pitch problems caused during the papermaking process.

Further, the amount of NaOH added in Step (2) is 0.5%-4%.

After treatment with hot water or hot steam in Step (1), the straw is slowly softened, and after adding a small amount of alkali, a part of the hemicellulose and lignin is quickly dissolved out and the raw materials are softened.

Further, the method of softening by hydrothermal saturation in Step (2) comprises: controlling the temperature of the hot water or steam to 80-120° C., and controlling the time to 20-60 min. Under this condition, the straw fiber raw material is softened as a whole, and the physical folding resistance of the fiber raw material is significantly improved, so it is difficult to break. The softening by hydrothermal saturation is mainly physical softening, which is quite beneficial for protecting the fiber from damage during mechanical refining. Compared with the traditional chemical pulp cooking, the temperature is 50° C. lower, the time is shortened by more than 60 min, the lignin is less dissolved, and the pulp yield is about 30% higher.

Further, at the end of treatment in Step (2), the pH of the straw is 7-10.

Further, the temperature in Step (3) is controlled to 40-60° C.

Further, the alkaline biological compound enzymes used in Step (3) are a compound enzyme of alkaline xylanase, alkaline cellulase, and alkaline pectinase, which is used in an amount of 10-80 IU/mL. The ratio of enzyme activity of the alkaline xylanase, alkaline cellulase and alkaline pectinase is 3-6:1-3:0.5-1.5. The alkaline biological compound enzymes of the present invention are used in place of a large amount of alkali, with which a good pulping performance and a high yield of straw pulp are obtained.

Further, the straw is wheat straw.

In a second aspect of the present invention, a mechanical pulp prepared by the method described above is provided.

In a third aspect of the present invention, use of the mechanical pulp described above in the preparation of unbleached packaging paper and paper-based materials is provided. To enable those skilled in the art to more clearly understand the technical solutions of the present invention, the technical solutions of the present invention will be described in detail below in conjunction with specific examples.

DEFINITIONS

Unbleached biomechanical pulp: It is a kind of pulp without any bleaching or color change, and maintaining the color of the raw material itself, which is obtained by physically and biologically treating a papermaking material containing a certain biomass and mechanically refining Softening by hydrothermal saturation: The straw material is soaked in hot water or steam at 80-120° C. for 20-60min. Under this condition, the fiber material of the straw is softened as a whole, and the physical folding resistance of the fiber raw material is significantly improved, so it is difficult to break. This process is known as softening by hydrothermal saturation. The softening by hydrothermal saturation is mainly physical softening, which is quite beneficial for protecting the fiber from damage during mechanical refining.

The biological enzymes used are from Shandong Longcote Enzyme Preparation Co., Ltd. and Novozymes (China) Biotechnology Co., Ltd.

Example 1: Method for Preparing Unbleached Biomechanical Pulp from Straw

The method comprises the following steps:

(1) The physically selected dedusted wheat straw was cut into 2 cm small raw materials, transferred to a treatment vessel or reactor at normal temperature, and treated with hot water at 100° C. at a solid/liquid ratio of 1:4 for a time of 30 min.

(2) 2.5% NaOH was added to the mixture of hot water and wheat straw in the reactor or treatment vessel, the pH of the hot water was adjusted to 14, the treatment time was 30 min, and the temperature was 100° C. A small amount of hemicellulose, lignin, pectin and other substances were dissolved out of the wheat straw. The wheat straw was softened by hydrothermally saturation, and the water content of the wheat straw reached pH 8 at the end of the treatment.

(3) The wheat straw softened by hydrothermal saturation and alkaline biological enzymes were treated in a biotreatment vessel or bioreactor for 90 min, where the temperature was controlled to 55° C., the solid/liquid ratio was controlled to 1:6 kg/L, the amount of enzymes used was 10 IU/mL, and the ratio of enzyme activity of alkaline xylanase, alkaline cellulase, and alkaline pectinase was 3:2:1. The wheat straw was continuously stirred and mixed to react the wheat straw and the biological enzymes fully to further soften the fibers of the wheat straw.

(4) The biologically treated wheat straw was refined using the KPF series high-concentration disc refiner for high-concentration refining in two stages with a refining gap of 0.3 mm in stage I and 0.15 mm in stage II, to give a pulp beating degree of 40 ° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The obtained biomechanical pulp was defibrated by a defibrater, evenly mixed, and then formed into corrugated paper of 60 g/m$^2$ on a paper former.

Control method 1: The biological enzyme was xylanase. The mixture of hot water and wheat straw in a reactor or treatment vessel was adjusted to pH 4.8 with 0.1 mol/L HAc-NaAC buffer. The temperature was 48° C., the treatment time was 90 min, and the enzyme dosage was 10 IU/mL, where the ratio of enzyme activity of acidic xylanase, acidic cellulase, and acidic pectinase was 3:2:1. The other steps were the same as those in Example 1.

Control method 2: The treatment with biolobical enzymes was omitted, and the other steps were the same as those in Example 1.

The tensile property of the pulp was measured according to GB/T453-2002, the tearing resistance was measured according to GB/T455-2002; and the ring-crush strength was measured according to GB/T2679.8-1995. The indicators are shown in Table 1 below.

TABLE 1

Performance measurements of biomechanical pulp by various methods

| Method | Beating degree/° SR | Tensile property (Km) | Tearing resistance/ mN · m$^2$ · g$^{-1}$ | Pulp yield % | Ring-crush strength |
|---|---|---|---|---|---|
| Example 1 | 40 | 3.28 | 3.53 | 81.3 | 10.12 |
| Control method 1 | 40 | 3.03 | 3.14 | 82.4 | 8.16 |
| Control method 2 | 40 | 2.81 | 3.27 | 83.5 | 7.27 |

Example 2: Method for Preparing Unbleached Biomechanical Pulp from Straw

The method comprises the following steps:

(1) The physically selected dedusted wheat straw was cut into 3 cm small raw materials, transferred to a treatment vessel or reactor, and treated with mixed hot water and steam at 110° C. at a solid/liquid ratio of 1:5 for a time of 40 min.

(2) 2% NaOH was added to the mixture of hot water and wheat straw in the reactor or treatment vessel, the pH of the hot water was adjusted to 13, the temperature was 95° C., and the treatment time was 30 min. A small amount of hemicellulose, lignin, pectin and other substances were dissolved out of the wheat straw. The wheat straw was softened by hydrothermally saturation, and the water content of the wheat straw reached pH 8 at the end of the treatment.

(3) The wheat straw softened by hydrothermal saturation and alkaline biological enzymes were treated in a biotreatment vessel or bioreactor for 60 min, where the temperature was controlled to 50° C., the solid/liquid ratio was controlled to 1:6 kg/L, the amount of enzymes used was 80 IU/mL, and the ratio of enzyme activity of alkaline xylanase, alkaline cellulase, and alkaline pectinase was 3:2:1.5. The wheat straw was continuously stirred and mixed to react the wheat straw and the biological enzymes fully to further soften the fibers of the wheat straw.

(4) The biologically treated wheat straw was refined using the KPF series high-concentration disc refiner for high-concentration refining in one stage with a refining gap of 0.15 mm, to give a pulp beating degree of 38° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The refined biomechanical pulp of wheat straw was defibrated by a defibrater, evenly mixed, and then formed into corrugated paper of 70 g/m$^2$ on a paper former. The physical strengths were then measured.

Control method 1: The biological enzyme was xylanase. The mixture of hot water and wheat straw in a reactor or treatment vessel was adjusted to pH 4.8 with 0.1 mol/L HAc-NaAC buffer. The temperature was 48° C., the treatment time was 60min, and the enzyme dosage was 80 IU/mL, where the ratio of enzyme activity of acidic xylanase, acidic cellulase, and acidic pectinase was 3:2:1.5. The other steps were the same as those in Example 2.

Control method 2: The treatment with biolobical enzymes was omitted, and the other steps were the same as those in Example 2.

The tensile property of the pulp was measured according to GB/T453-2002, the tearing resistance was measured according to GB/T455-2002; and the ring-crush strength was measured according to GB/T2679.8-1995. The indicators are shown in Table 2 below.

TABLE 2

Performance measurements of biomechanical pulp by various methods

| Method | Beating degree/° SR | Tensile property (Km) | Tearing resistance/ mN · m$^2$ · g$^{-1}$ | Pulp yield % | Ring-crush strength |
|---|---|---|---|---|---|
| Example 2 | 38 | 3.22 | 3.63 | 82.1 | 10.25 |
| Control method 1 | 38 | 2.93 | 3.14 | 82.9 | 7.37 |
| Control method 2 | 38 | 2.78 | 3.31 | 83.3 | 7.64 |

Example 3: Method for Preparing Unbleached Biomechanical Pulp from Straw (1) The physically selected dedusted wheat straw was cut into 2 cm small raw materials, transferred to a treatment vessel or reactor, and treated with hot water at 95° C. at a solid/liquid ratio of 1:4 for a time of 60 min.

(2) 1.5% KOH was added to the mixture of hot water and wheat straw in the reactor or treatment vessel, the pH of the hot water was adjusted to 13, the treatment time was 30 min, and the temperature was 100° C. A small amount of hemicellulose, lignin, pectin and other substances were dissolved out of the wheat straw. The wheat straw was softened by hydrothermally saturation, and the water content of the wheat straw reached pH 8 at the end of the treatment.

(3) The wheat straw softened by hydrothermal saturation and alkaline biological enzymes were treated in a biotreatment vessel or bioreactor for 70 min, where the temperature was controlled to 55° C., the solid/liquid ratio was controlled to 1:8 kg/L, the amount of enzymes used was 60 IU/mL, and the ratio of enzyme activity of alkaline xylanase, alkaline cellulase, and alkaline pectinase was 3:2:1.5. The wheat straw was continuously stirred and mixed to react the wheat straw and the biological enzymes fully to further soften the fibers of the wheat straw.

(4) The biologically treated wheat straw was refined using the KPF series high-concentration disc refiner for high-concentration refining in one stage with a refining gap of 0.2 mm, to give a pulp beating degree of 42 ° SR.

(5) The pulp was washed with water after refining to obtain a biomechanical pulp, where after washing the pulp, the water was treated with a multi-purpose evaporator, the solid residue was recovered for incineration in a boiler, and the heat energy was recovered for the treatment with hot water or steam in Step (1).

(6) The refined biomechanical pulp of wheat straw was defibrated by a defibrater, evenly mixed, and then formed into corrugated paper of 60g/m$^2$ on a paper former.

Control method 1: The mixture of hot water and wheat straw in a reactor or treatment vessel was adjusted to pH 4.8 with 0.1 mol/L HAc-NaAC buffer. The temperature was 48° C., the treatment time was 70min, and the enzyme dosage was 60 IU/mL, where the ratio of enzyme activity of acidic xylanase, acidic cellulase, and acidic pectinase was 3:2:1.5. The other steps were the same as those in Example 3.

Control method 2: The treatment with biolobical enzymes was omitted, and the other steps were the same as those in Example 3.

The tensile property of the pulp was measured according to GB/T453-2002, the tearing resistance was measured according to GB/T455-2002; and the ring-crush strength was measured according to GB/T2679.8-1995. The indicators are shown in Table 3 below.

TABLE 3

Performance measurements of biomechanical pulp by various methods

| Method | Beating degree/° SR | Tensile property (Km) | Tearing resistance/ mN · m$^2$ · g$^{-1}$ | Pulp yield % | Ring-crush strength |
|---|---|---|---|---|---|
| Example 3 | 42 | 3.01 | 3.74 | 80.2 | 9.98 |
| Control method 1 | 42 | 2.92 | 3.32 | 80.3 | 7.51 |
| Control method 2 | 42 | 2.61 | 3.43 | 81.1 | 7.43 |

The above examples are preferred embodiments of the present invention, but the embodiments of the present invention are not limited to thereto. Any other changes, modifications, replacements, combinations, and simplifications may be made without departing from the spirit and scope of the present invention, which are all embraced in the scope of the present invention.

What is claimed is:

1. A method for preparing an unbleached biomechanical pulp from straw, comprising the following steps:

(1) cutting a physically selected dedusted straw into 1-8 cm small raw materials, transferring the small raw materials to a treatment vessel or reactor, and treating the small raw materials with steam or water at a temperature of 80-120° C. at a solid/liquid ratio of 1:4-1:8 (kg/L) forming a treated straw, for a time controlled to 15-90 min;

(2) adding NaOH or KOH to the treated straw in the reactor or the treatment vessel, to adjust a pH of the water at a temperature of 80-120° C. to 10-14, and softening the treated straw by hydrothermal saturation forming a hydrothermally saturated straw;

(3) treating the hydrothermally saturated straw with alkaline biological compound enzymes in a biotreatment vessel for 30-90 min at a solid/liquid ratio controlled to 1:3-1:10 W/V;

(4) refining the straw treated in Step (3) with a refiner;

(5) washing with water after refining to obtain a biomechanical pulp, where after washing the biomechanical pulp, the water after washing is treated with a multi-purpose evaporator, a solid residue is recovered for incineration in a boiler, and heat energy is recovered for use in supplying the water at a temperature of 80-120° C. or steam in Step (1); and (6) defibrating the biomechanical pulp by a defibrater and evenly mixing.

2. The method according to claim 1, wherein an amount of NaOH or KOH added in Step (2) is 0.5-4%.

3. The method according to claim 1, wherein the method of softening by hydrothermal saturation in Step (2) comprises: controlling the temperature of the water or steam to 80-120° C., and controlling the time to 20-60 min.

4. The method according to claim 1, wherein at the end of treatment in Step (2), a pH of hydrothermally saturated straw is 7-10.

5. The method according to claim 1, wherein a temperature in Step (3) is controlled to 40-60° C.

6. The method according to claim 1, wherein the alkaline biological compound enzymes used in Step (3) are a compound enzyme of alkaline xylanase, alkaline cellulase, and alkaline pectinase, and an amount of the alkaline biological compound enzymes in a solution formed in Step (3) at a temperature of 40-60° C. is 10-80 IU/mL, wherein a ratio of enzyme activity of the alkaline xylanase, alkaline cellulase and alkaline pectinase is 3-6:1-3:0.5-1.5.

7. The method according to claim 1, wherein the physically selected dedusted straw is a physically selected dedusted wheat straw.

* * * * *